US009341969B2

(12) United States Patent
Kataoka et al.

(10) Patent No.: US 9,341,969 B2
(45) Date of Patent: May 17, 2016

(54) TONER FOR ELECTROSTATIC DEVELOPMENT, IMAGE FORMING DEVICE USING SAME, AND IMAGE FORMING METHOD

(71) Applicant: SHARP KABUSHIKI KAISHA, Osaka-shi, Osaka (JP)

(72) Inventors: Toshiharu Kataoka, Osaka (JP); Yasuo Imura, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 2 days.

(21) Appl. No.: 14/378,159

(22) PCT Filed: Feb. 7, 2013

(86) PCT No.: PCT/JP2013/052916

§ 371 (c)(1),
(2) Date: Aug. 12, 2014

(87) PCT Pub. No.: WO2013/121981

PCT Pub. Date: Aug. 22, 2013

(65) Prior Publication Data

US 2015/0010860 A1 Jan. 8, 2015

(30) Foreign Application Priority Data

Feb. 14, 2012 (JP) ..... 2012-029901

(51) Int. Cl.
*G03G 9/08* (2006.01)
*G03G 9/087* (2006.01)

(52) U.S. Cl.
CPC ..... *G03G 9/08724* (2013.01); *G03G 9/081* (2013.01); *G03G 9/0819* (2013.01); *G03G9/08708* (2013.01); *G03G 9/08711* (2013.01); *G03G 9/08755* (2013.01); *G03G 9/08782* (2013.01); *G03G 9/08793* (2013.01); *G03G 9/08795* (2013.01); *G03G 9/08797* (2013.01); *G03G 2215/0604* (2013.01)

(58) Field of Classification Search
CPC ..... G03G 9/08711; G03G 9/08755; G03G 9/0819
USPC ..... 430/109.3, 109.4, 118.8
See application file for complete search history.

(56) References Cited

U.S. PATENT DOCUMENTS 6,002,903 A * 12/1999 Hayase et al. ..... 430/45.54
2010/0248121 A1 9/2010 Sakata et al.

FOREIGN PATENT DOCUMENTS

| | | |
|---|---|---|
| JP | 2001-188383 | 7/2001 |
| JP | 2008-164677 | 7/2008 |
| JP | 2011-248253 | 12/2011 |
| WO | 2009/028176 | 3/2009 |

OTHER PUBLICATIONS

International Search Report for PCT/JP2013/052916, mailed Mar. 19, 2013.
Written Opinion of the Isa for PCT/JP2013/052916, mailed Mar. 19, 2013.

* cited by examiner

*Primary Examiner* — Mark A Chapman
(74) *Attorney, Agent, or Firm* — Nixon & Vanderhye P.C.

(57) ABSTRACT

Toner for electrostatic development in accordance with one aspect of the present invention contains toner base particles produced by subjecting a toner composition containing binder resin, a coloring agent, and wax to melting and kneading and thereafter pulverization and classification, the toner having a volume median particle diameter (D50) of 5.5 to 7.5 μm, and the toner having particle size distribution in which the toner base particles include 15 to 55% by number of toner base particles of not more than 5 μm in particle diameter, and include not more than 1.5% by number of toner particles of more than 10 μm in particle diameter.

6 Claims, 1 Drawing Sheet

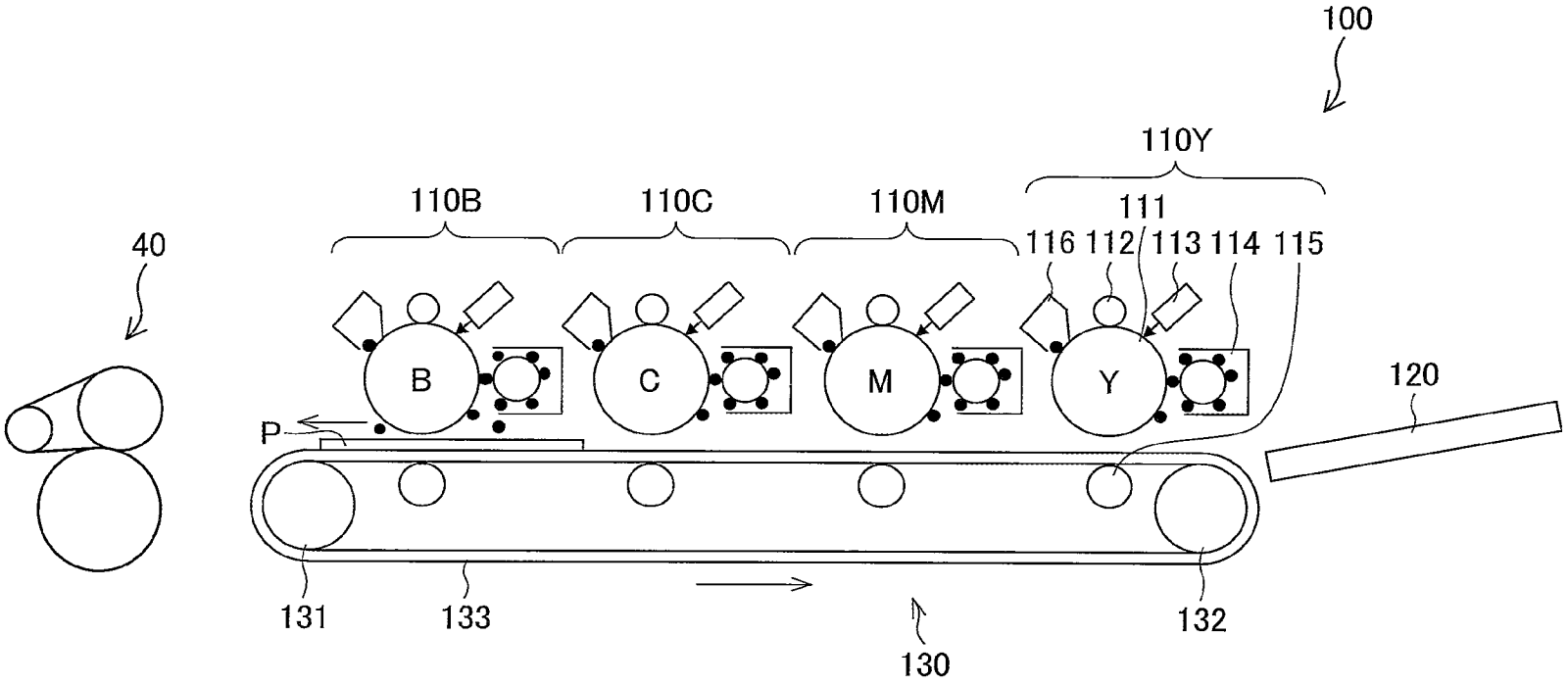
100
110Y
111
112
113
114
115
116
120
110M
110C
110B
Y
M
C
B
P
130
131
132
133
40

TONER FOR ELECTROSTATIC DEVELOPMENT, IMAGE FORMING DEVICE USING SAME, AND IMAGE FORMING METHOD

This application is the U.S. national phase of International Application No. PCT/JP2013/052916 filed 7 Feb. 2013 which designated the U.S. and claims priority to JP Patent Application No. 2012-029901 filed 14 Feb. 2012, the entire contents of each of which are hereby incorporated by reference.

TECHNICAL FIELD

The present invention relates to a toner for electrostatic development, an image forming device using the toner, and an image forming method using the toner.

BACKGROUND ART

Recently, in the technique of forming an image based on electrophotography, full color, high image quality, and high speed performance have been required. In accordance with these requests, there have been made technical developments such as coloring of toners, downsizing of particles of toners, establishment of low-temperature fixability and high-temperature offset resistance.

Recently, various proposals have been made as to techniques intended for improving the low-temperature fixability of toners, such as a technique using both polyester resin and low-melting wax and a technique using crystalline polyester. However, it is difficult to technically establish both of the low-temperature fixability and the high-temperature offset resistance, and so there have been discussed toners such as toners using polyester resin containing a gel component and toners whose molecular weight is regulated.

Furthermore, in order to realize a high-definition and high quality image, particles of toners are downsized. However, toners made of polyester resin with low grindability tend to require a larger amount of energy consumed in a pulverization process for downsizing particles. Furthermore, there is a problem that although a large amount of energy is consumed for pulverization, only toner particles whose particle size distribution is wide can be obtained.

In order to reduce energy consumed in the pulverization process and obtain toner particles whose particle size distribution is narrow, there have been discussed additives such as a grinding aid and a plasticizer and an adding method. For example, Patent Literature 1 describes that binder resin contains at least carboxyl group-containing vinyl resin and glycidyl group-containing vinyl resin and contains 5 to 50% by mass of a THF insoluble component in binder resin components of toner. It is reported that this allows low-temperature fixation regardless of a configuration of a fixing device, allows excellent high-temperature offset resistance, prevents occurrence of image defect due to time lapse or being left unattended, and allows a stable and high image quality regardless of whether the toner is used under a low moisture or a high moisture.

Furthermore, Patent Literature 2 describes (1) binder resin for color toners, wherein the binder resin comprises at least carboxyl group-containing vinyl resin (C), glycidyl group-containing vinyl resin (E) and a reaction product thereof, a content of a THF insoluble gel portion is less than 1 mass %, and a softening point is not more than 130° C., and (2) binder resin for color toners, wherein a storage modulus G' at 160° C. is not less than 50 Pa and less than 10,000 Pa measured at a frequency of 6.28 rad/sec. It is reported that such binder resin allows providing a color toner which has excellent gloss and is suitable for a color toner.

CITATION LIST

Patent Literatures

[Patent Literature 1]
Japanese Patent Application Publication No. 2001-188383 (published on Jul. 10, 2001)
[Patent Publication 2]
WO 2009/028176, pamphlet (Mar. 5, 2009)

SUMMARY OF INVENTION

Technical Problem

In order to realize a high-definition image, downsizing of particles of toner is necessary, and in order to improve low-temperature fixability, it is useful to use polyester resin as binder resin and incorporate low-melting wax into the binder resin. However, a combination of only polyester resin and low-melting wax results in excess of gloss, and besides causes a problem in the high-temperature offset resistance, and accordingly it is difficult to realize both the low-temperature fixability and the high-temperature offset resistance.

Furthermore, since polyester resin has low grindability, downsizing of particles of toner requires excessive energy consumption in a pulverization process. Furthermore, since polyester resin has low grindability, particle size distribution of polyester resin tends to be wide, so that downsizing of particles of toner only results in pulverized particles whose particle size distribution includes small-sized particles more than necessary. In the pulverization process, a kneaded product tends to be cleaved along wax and expose the wax on a surface of the kneaded product, so that as the pulverized particles include a larger number of small-sized particles, wax is more likely to be exposed on a surface of a particle. Toner having small-sized particles, which uses polyester resin with low grindability as binder resin, contains small-sized particles more than necessary, so that more number of wax is exposed at a surface of a particle and the toner loses flowability.

The present invention was made in view of the foregoing problems. An object of the present invention is to provide a toner for electrostatic development, which realizes stable fixing performance by realizing both of low-temperature fixability and high-temperature offset resistance, which has excellent grindability and flowability, and which is capable of forming a high-definition high quality image; an image forming device using the toner; and an image forming method using the toner.

Solution to Problem

In order to solve the foregoing problem, toner for electrostatic development in accordance with one aspect of the present invention contains toner base particles produced by subjecting a toner composition containing binder resin, a coloring agent, and wax to melting and kneading and thereafter pulverization and classification, the binder resin containing polyester resin and crosslinked styrene resin, the polyester resin being in an amount of 75 to 95% by weight and the crosslinked styrene resin being in an amount of 3 to 20% by weight with respect to 100% by weight of the binder resin, the crosslinked styrene resin containing COOH group-containing vinyl resin and glycidyl group-containing vinyl resin, a THF insoluble component in the crosslinked styrene resin being in an amount of 15 to 45% by weight, and the toner having particle size distribution in which a volume median particle diameter (D50) is 5.5 to 7.5 μm, and the toner base particles include 15 to 55% by number of toner base particles of not more than 5 μm in particle diameter, and include not more than 1.5% by number of toner particles of more than 10 μm in particle diameter.

Advantageous Effects of Invention

The present invention yields effects such as: realization of stable fixing performance by securing both of low-temperature fixability and high-temperature offset resistance; excellent grindability and flowability; and formation of high-definition and high quality images.

BRIEF DESCRIPTION OF DRAWINGS

FIG. 1 is an explanatory view illustrating a configuration example of an image forming device using toner for electrophotography of the present invention.

DESCRIPTION OF EMBODIMENTS

Image Forming Apparatus

FIG. 1 is an explanatory view illustrating a configuration example of an image forming apparatus using an electrophotography-use toner (hereinafter abbreviated as toner) of the present invention.

An image forming apparatus 100 is a printer based on an electrophotographic method, and employs a so-called tandem type in which four visible image forming units (yellow visible image forming unit 110Y, magenta visible image forming unit 110M, cyan visible image forming unit 110C, and black visible image forming unit 110B, which may be collectively referred to as visible image forming unit 110) are arranged along a recording paper carrying path.

Specifically, the four visible image forming units 110 are arranged along a carrying path for carrying a sheet of recording paper P (transfer medium, recording medium). The carrying path is provided between a supply tray 120 for supplying a sheet of recording paper P to the visible image forming units 110 and a fixing device 40. The visible image forming units 110 transfer toner images of respective colors to the sheet of recording paper P carried by an endless carrying belt 133 serving as recording paper carrying means 130, in such a manner that the toner images of respective colors are overlapped with each other. Thereafter, the fixing device 40 fixes the toner images onto the sheet of recording paper P so as to form a full color image.

The carrying belt 133 is provided in a tensioned state between a driving roller 131 and an idling roller 132, and is controlled to rotate at a predetermined peripheral velocity (150-400 mm/sec. or so, e.g. 220 mm/sec.). The sheet of recording paper P is carried by the rotating carrying belt 130 by electrostatically attaching the sheet of recording paper P to the carrying belt 130.

Each of the visible image forming units 110 includes a photoreceptor drum 111. Each of the visible image forming units 110 further includes a charging roller 112, exposing means (laser light radiation means) 113, a developing device 114, a transfer roller 115, and a cleaner 116 which are provided around the photoreceptor drum 111.

A developing device Y of the visible image forming unit 110Y contains a developer including a yellow toner, a developing device M of the visible image forming unit 110M contains a developer including a magenta toner, a developing device C of the visible image forming unit 110C contains a developer including a cyan toner, and a developing device B of the visible image forming unit 110B contains a developer including a black toner.

In each of the visible image forming units 110, a toner image is transferred to a sheet of the recording paper P as follows. Initially, the charging roller 112 uniformly charges a surface of the photoreceptor drum 111, and thereafter the laser light radiation means 113 exposes the surface of the photoreceptor drum 111 with laser light according to image information, thereby forming an electrostatic latent image. Thereafter, the developing device 114 supplies toner to the electrostatic latent image on the surface of the photoreceptor drum 111. Thus, the electrostatic latent image is developed (made visible) to be a toner image. By the transfer roller 115, to which a bias voltage with a polarity opposite to that of toner of the toner image on the surface of the photoreceptor drum 111 is applied, such toner images are sequentially transferred onto a sheet of the recording paper P carried by the carrying belt (carrying means) 130

Thereafter, the sheet of the recording paper P is peeled off from the carrying belt 133 at a curved portion thereof (a portion winding around the driving roller 131), and is carried to the fixing device 40. In the fixing device 40, a fixing belt which is heated to a predetermined temperature applies an appropriate heat and an appropriate pressure to the sheet of the recording paper P. Consequently, the toners on the sheet of the recording paper P are melted and fixed onto the sheet of the recording paper P, so that an image is fixedly formed on the sheet of the recording paper P.

(Overview of Toner)

In the present embodiment, as a result of discussing a content of crosslinked styrene resin and a particle size distribution of a toner, the inventors have found a toner which has an improved high-temperature offset resistance, improved grindability, secured flowability, and excellent fixing performance, and which can realize excellent developing property and high-definition images.

A toner in accordance with the embodiment of the present invention is a toner produced by subjecting a toner composition containing binder resin made of at least polyester resin and crosslinked styrene resin, a coloring agent, and wax to melting and kneading and thereafter pulverization and classification. The toner may contain a charge control agent. Since the crosslinked styrene resin contains % by weight-high content of a THF insoluble component (15% by weight to 45% by weight) which is a super macromolecule body, addition of approximately 5% by weight to 25% by weight of crosslinked styrene resin into the polyester resin yields an effect of improving the high-temperature offset resistance of a toner and an effect of improving grindability of the toner.

Furthermore, by improving grindability of the toner, it is possible to subdue the amount of energy consumed in the pulverization process. Furthermore, by improving grindability of the toner, it is possible to uniform pulverized particles in particle size. Consequently, it is possible to downsize particles of the toner while reducing small particle content with particle diameters of not more than 5 μm in the toner, so that it is possible to reduce an amount of exposed wax.

Furthermore, the crosslinked styrene resin has good compatibility with hydrocarbon wax or aliphatic hydrocarbon wax, and also serves as a compatibilizer for wax in the polyester resin. Consequently, the toner in accordance with the embodiment of the present invention has high dispersibility of wax, so that the toner is less likely to be cleaved at the wax in pulverization and reduces exposure of the wax on a surface of a particle.

In the present embodiment, as above, by adding approximately 5% by weight to 25% by weight of the crosslinked styrene resin into the polyester resin, particles of a small particle diameter can be reduced due to improvement in grindability, so that it is possible to reduce exposure of wax on a surface of a particle. Consequently, it is possible to provide a toner with good flowability and an excellent developing property.

A toner in accordance with the embodiment of the present invention is a toner produced by subjecting a toner composition containing binder resin made of at least polyester resin and crosslinked styrene resin, a coloring agent, and wax to melting and kneading and thereafter pulverization and classification. The toner has a particle size distribution in which a volume median particle diameter (D50) of the toner is in a range of 5.5 μm to 7.5 μm, a content ratio of toner base particles of not more than 5 μm in particle diameter is in a range of 15% by number to 55% by number, and a content ratio of toner base particles of more than 10 μm in particle diameter is 1.5% by number or less. With this particle size distribution, it is possible to form a high definition and high quality image.

In the particle size distribution, when the content ratio of toner base particles of not more than 5 μm in particle diameter is more than 55% by number, exposure of low-melting wax increases and flowability of the toner drops. When the content ratio of toner base particles of not more than 5 μm in particle diameter is less than 15% by number, it is impossible to realize an image with high definition. When a volume median particle diameter (D50) of the toner base particles is less than 5.5 μm, exposure of the low-melting wax increases in pulverization and flowability of the toner drops. When the volume median particle diameter (D50) of the toner base particles is more than 7.5 μm, it is difficult to form an image with high definition. Furthermore, when the content ratio of toner base particles of more than 10 μm in particle diameter is larger than 1.5% by number, it is difficult to form an image with high definition. Accordingly, it is preferable that the toner does not contain the toner base particles of more than 10 μm in particle diameter.

(Crosslinked Styrene Resin)

The crosslinked styrene resin used in the toner in accordance with the embodiment of the present invention contains a THF insoluble component. The THF insoluble component is contained in a three-dimensional structure in the resin which structure has been formed by a crosslinking reaction between a glycidyl group and a COOH group respectively derived from a glycidyl group-containing compound and a COOH group-containing vinyl resin used in the crosslinked styrene resin.

A COOH group-containing vinyl monomer used in production of the COOH group-containing vinyl resin is at least one of monoesters of unsaturated dibasic acid, such as acrylic acid, methacrylic acid, maleic anhydride, maleic acid, fumaric acid, cinnamic acid, methyl fumarate, ethyl fumarate, propyl fumarate, butyl fumarate, octyl fumarate, methyl maleate, ethyl maleate, propyl maleate, butyl maleate, and octyl maleate.

Examples of vinyl monomers copolymerizable with the COOH group-containing vinyl monomer include styrenes such as styrene, P-methylstyrene, α methylstyrene, and vinyltoluene, acrylic esters such as methyl acrylate, ethyl acrylate, propyl acrylate, butyl acrylate, octyl acrylate, cyclohexyl acrylate, stearyl acrylate, benzyl acrylate, furfuryl acrylate, hydroxyethyl acrylate, hydroxybutyl acrylate, dimethyl amino methyl acrylate, and dimethyl amino ethyl acrylate, methacrylic esters such as methyl methacrylate, ethyl methacrylate, propyl methacrylate, butyl methacrylate, octyl methacrylate, cyclohexyl methacrylate, stearyl methacrylate, benzyl methacrylate, furfuryl methacrylate, hydroxyethyl methacrylate, hydroxybutyl methacrylate, dimethyl amino methyl methacrylate, and dimethyl amino ethyl methacrylate, diesters of unsaturated dibasic acids such as dimethyl fumarate, dibutyl fumarate, dioctyl fumarate, dimethyl maleate, dibutyl maleate, and dioctyl maleate, unsaturated carboxylic acids such as acrylonitrile, meta-acrylonitrile, acrylic acid, methacrylic acid and cinnamic acid, acrylamide, meta-acrylamide, N-substituted acrylamide, N-substituted methacrylamide, acrylamide propanesulfonic acid, etc. At least one of these monomers is used. Particularly preferable examples of these vinyl monomers include styrenes, acrylic esters, methacrylic esters, fumaric acid dialkyl esters, acrylonitrile, acrylamide, and methacrylamide.

COOH group-containing vinyl resin is prepared by polymerizing the COOH group-containing vinyl monomer with the vinyl monomer, preparing a low molecular weight polymerization solution and a high molecular weight polymerization solution, sufficiently mixing these polymerization solutions, and removing a solvent from the resultant. A weight average molecular weight (Mw) of the COOH group-containing vinyl resin is preferably in a range of 100,000 to 1,000,000 and an acid value of the COOH group-containing vinyl resin is preferably in a range of 1.0 to 20 KOHmg/g.

A method for producing the COOH group-containing vinyl resin is preferably a solution polymerization. An example is described below. A solution obtained by evenly dissolving and mixing (i) at least one solvent selected from aromatic hydrocarbon such as benzene, toluene, ethylbenzene, xylene, and cumene, SOLVESSO #100, #150 (product name, manufactured by Esso Chemical) etc., (ii) a vinyl monomer, and (iii) a polymerization initiator, is continuously supplied to a pressure tight case fully filled with a solvent in advance while maintaining a certain temperature and a certain inner pressure, thereby carrying out polymerization. After the polymerization reaches a static state, the resultant is stored in a tank as a low molecular weight polymerization solution. Separately, a high molecular weight polymerization solution is obtained by bulk solution polymerization. The low molecular weight polymerization solution and the high molecular weight polymerization solution are sufficiently mixed and melted with each other, and then the resultant is continuously flushed into a vacuum system of approximately 0 to 200 mmHg so as to remove the solvent etc. and separate vinyl resin from the solvent, thereby obtaining solid COOH group-containing vinyl resin.

A glycidyl compound used in the embodiment of the present invention is preferably glycidylester-containing vinyl resin whose weight average molecular weight is 3,000 to 10,000 and whose epoxy value is 0.01 to 0.5 Eq/100 g. The glycidylester-containing vinyl resin is obtained by copolymerizing (a) at least one of glycidyl group-containing vinyl monomers with (b) other vinyl monomer. Examples of the glycidyl group-containing vinyl monomers encompasses glycidyl acrylate, β methyl glycidyl acrylate, glycidyl methacrylate, and methacrylic acid β methyl glycidyl methacrylate.

In the embodiment of the present invention, the COOH group-containing vinyl resin, the glycidyl group-containing resin, and polyolefin wax in respective predetermined amounts are mixed with one another by a Henschel mixer and then melted and kneaded by a two-axis kneader etc. at a temperature of 160 to 220° C. so that the COOH group and the glycidyl group are sufficiently reacted with each other, and thus crosslinked styrene resin containing polyolefin wax is produced.

Styrene resin used in the embodiment of the present invention preferably has a weight average molecular weight of 50,000 to 500,000 and a softening point of 130 to 160° C. When the weight average molecular weight is less than 50,000 or the softening point is less than 130° C., it is impossible to obtain good grindability and high-temperature offset resistance. When the weight average molecular weight is more than 500,000 or the softening point is more than 160° C., it is difficult to secure low-temperature fixability.

The styrene resin used in the embodiment of the present invention preferably contains 15 to 45% by weight of the THF insoluble component. When the THF insoluble component is less than 15% by weight, grindability cannot be improved. When the THF insoluble component is more than 45% by weight, the low-temperature fixability is adversely influenced.

(Polyester Resin)

Polyester resin used in the embodiment of the present invention is non-crystalline polyester resin, and can be obtained by condensation-polymerizing a publicly known multivalent alcohol component with a monomer containing a multivalent carboxylic acid component.

Examples of a divalent alcohol component include alkylene oxide adducts of bisphenol A such as polyoxypropylene (2.2)-2,2-bis 4-hydroxyphenyl propane, polyoxypropylene (3.3)-2,2-bis 4-hydroxyphenyl propane, polyoxyethylene (2.2)-2,2-bis 4-hydroxyphenyl propane, polyoxypropylene (2.0)-polyoxyethylene (2.0)-2,2-bis 4-hydroxyphenyl propane, and polyoxypropylene (6)-2,2-bis 4-hydroxyphenyl propane, ethylene glycol, diethylene glycol, triethylene glycol, 1,2-propylene glycol, 1,3-propylene glycol, 1,4-butanediol, neopentylglycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adduct of bisphenol A, ethylene adduct of bisphenol A, hydrogenated bisphenol A, etc.

Examples of trivalent or higher alcohol components include sorbitol, 1,2,3,6-hexane tetrol, 1,4-sorbitan, pentaerythritol, dipenta erythritol, tripenta erythritol, 1,2,4-butanetriol, 1,2,5-pentanetriol, glycerol, 2-methylpropane triol, 2-methyl-1,2,4-butanetriol, trimethylolethane, trimethylolpropane, 1,3,5-trihydroxy methylbenzene, etc. Examples of the acid component include bivalent carboxylic acid components and trivalent or higher carboxylic acid components.

Examples of bivalent carboxylic acid components include maleic acid, fumaric acid, citraconic acid, itaconic acid, glutaconic acid, phthalic acid, isophthalic acid, terephthalic acid, succinic acid, adipic acid, a sebacic acid, azelaic acid, malonic acid, n-dodecenyl succinic acid, isododecenyl succinic acid, n-dodecylsuccinic acid, isododecylsuccinic acid, n-octenylsuccinic acid, n-octyl succinic acid, isooctenylsuccinic acid, isooctylsuccinic acid, and anhydrides of these acids, or lower alkyl ester thereof etc.

Examples of trivalent or higher carboxylic acid components include 1,2,4-benzenetricarboxylic acid, 2,5,7-naphthalenetricarboxylic acid, 1,2,4-naphthalenetricarboxylic acid, 1,2,4-butane tricarboxylic acid, 1,2,5-hexane tricarboxylic acid, 1,3-dicarboxyl 2-methyl-2-methylenecarboxypropane, 1,2,4-cyclohexanetricarboxylic acid, tetramethylene carboxyl methane, 1,2,7,8-octanetetracarboxylic acid, pyromellitic acid, enpol trimer acid and acid anhydrides thereof, lower alkyl ester thereof, etc.

Among them, 1,2,4-benzenetricarboxylic acid in particular, i.e. trimellitic acid or its derivatives are preferably used since they are cheap and easy to control their reactions.

It is preferable that the non-crystalline polyester resin used in the embodiment of the present invention is synthesized from an alcohol component made of an alkylene oxide adduct of bisphenol A and an acid component. Preferable examples of the alkylene oxide adduct of bisphenol A include polyoxypropylene (2.2)-2,2-bis 4-hydroxyphenyl propane and polyoxyethylene (2.2)-2,2-bis 4-hydroxyphenyl propane. It is preferable that non-crystalline polyester resin used in the embodiment of the present invention contains at least trimellitic acid (or anhydrous trimellitic acid) as the acid component.

It is preferable that the non-crystalline polyester resin used in the embodiment of the present invention has a softening point of 110 to 150° C. In particular, it is more preferable to mix low molecular weight polyester resin having a softening point of 100 to 130° C. and high molecular weight polyester resin having a softening point of 130 to 160° C. for use. It is preferable that a ratio of mixing the low molecular weight polyester resin with the high molecular weight polyester resin is in a range of 30:70 to 70:30. When the softening point of the non-crystalline polyester resin is less than 110° C., there arise problems in high-temperature offset resistance and storage stability of the toner. When the softening point of the non-crystalline polyester resin is more than 150° C., it is impossible to secure low-temperature fixability of the toner.

Binder resin used in the toner in accordance with the embodiment of the present invention is a combination of the non-crystalline polyester resin and the crosslinked styrene resin. It is preferable that 75-95% by weight of the non-crystalline polyester resin and 5-25% by weight of the crosslinked styrene resin are mixed. When less than 5% by weight of the crosslinked styrene resin is mixed, it is impossible to obtain good grindability and high-temperature offset resistance. When more than 25% by weight of the crosslinked styrene resin is mixed, there arises a problem in low-temperature fixability.

(Wax)

In the embodiment of the present invention, at least low-melting wax is used. Preferable examples of the low-melting wax include ester wax, paraffin wax, and carnauba wax, each having a melting point in a range of 70° C. to 100° C. The low-melting wax is incorporated into toner by melting and kneading the low-melting wax together with toner compositions such as polyester resin, crosslinked styrene resin, and a coloring agent. A content of the low-melting wax is preferably in a range of 2% by weight to 8% by weight with respect to 100% by weight of binder resin. When the content of the low-melting wax is less than 2% by weight, toner cannot have good low-temperature fixability. When the content of the low-melting wax is more than 8% by weight, flowability of toner drops and a developing property of toner worsens.

In the embodiment of the present invention, high-melting wax and low-melting wax may be used in combination. The high-melting wax used herein is polyolefin wax whose melting point is in a range of 120 to 160° C., which does not have an acid value and a hydroxyl group value, and has high compatibility with styrene resin. The polyolefin wax used herein is selected from the group consisting of polyethylene wax, polypropylene wax, ethylene-propylene copolymer wax, and Fischer-Tropsch wax. It is preferable that the high-melting wax is used in such a manner that the high-melting wax is melted and kneaded together with crosslinked styrene resin so as to be internally added to the crosslinked styrene resin. A content of the high-melting wax is preferably in a range of 1% by weight to 6% by weight with respect to 100% by weight of the crosslinked styrene resin. When the content of the high-melting wax is less than 1% by weight, a fixing property of the crosslinked styrene resin drops. When the content of the high-melting wax is more than 6% by weight, flowability of the toner drops and a developing property of the toner worsens.

(Coloring Agent)

The coloring agent may be one normally used in the field to which the present invention pertains. Examples of the coloring agent include a coloring agent for a yellow toner, a coloring agent for a magenta toner, a coloring agent for a cyan toner, and a coloring agent for a black toner.

Examples of the coloring agent for a yellow toner include azo pigments such as C.I. pigment yellow 1, C.I. pigment yellow 5, C.I. pigment yellow 12, C.I. pigment yellow 15, and C.I. pigment yellow 17 which are classified by a color index, inorganic pigments such as yellow iron oxide and ocher, nitro dyes such as C.I. acid yellow 1, and oil-soluble dyes such as C.I. solvent yellow 2, C.I. solvent yellow 6, C.I. solvent yellow 14, C.I. solvent yellow 15, C.I. solvent yellow 19, and C.I. solvent yellow 21.

Examples of the coloring agent for a magenta toner include C.I. pigment red 49, C.I. pigment red 57, C.I. pigment red 81, C.I. pigment red 122, C.I. solvent red 19, C.I. solvent red 49, C.I. solvent red 52, C.I. basic red 10, C.I. disperse red 15 which are classified by a color index.

Examples of the coloring agent for a cyan toner include C.I. pigment blue 15, C.I. pigment blue 16, C.I. solvent blue 55, C.I. solvent blue 70, C.I. direct blue 25, and C.I. direct blue 86 which are classified by a color index.

Examples of the coloring agent for a black toner include carbon blacks such as channel black, roller black, disc black, gas furnace black, oil furnace black, thermal black, and acetylene black. Out of these various kinds of carbon blacks, a suitable carbon black may be appropriately selected in accordance with design characteristics of toner to be obtained.

Other than these pigments, a sanguine pigment, a green pigment etc. may be used. One kind of a coloring agent may be used alone, or two or more kinds of coloring agents may be used in combination. Two or more kinds of coloring agents belonging to the same color system may be used, or single coloring agents respectively belonging to different color systems or two or more groups of coloring agents respectively belonging to different color systems may be used.

The amount of the coloring agent to be used is not particularly limited, and is preferably in a range of 4 parts by weight to 12 parts by weight with respect to 100 parts by weight of binder resin. Use of the coloring agent in this range allows forming an image which has high image density and which has very good image quality, without damaging properties of the toner. Furthermore, use of the coloring agent in this range allows reducing the amount of the toner to be used, thereby contributing to reduction in costs. When the amount of the coloring agent to be added is less than 4 parts by weight, image density drops. Consequently, in order to increase image density, it is necessary to increase the amount of the toner to be attached to a sheet, resulting in an increase in the amount of the toner to be used. When the amount of the coloring agent to be added is more than 12 parts by weight, a problem is likely to occur in color reproducibility.

(Charge Control Agent)

The charge control agent may be one for positive charge control or one for negative charge control normally used in the field to which the present invention pertains. Examples of the charge control agent for positive charge control include nigrosine dye, a basic dye, quarternary ammonium salt, quarternary phosphonium salt, aminopyrine, a pyrimidine compound, a polynuclearpoly amino compound, aminosilane, nigrosine dye and its derivative, a triphenylmethane derivative, guanidine salt, and amidine salt.

Examples of the charge control agent for negative charge control include oil soluble dyes such as oil black and spiron black, a metal-containing azo compound, an azo complex dye, metal naphthenate, a metal compound of benzyl acid derivative (metal is boron, aluminum etc.), a metal complex and metal salt of salicylic acid and its derivative (metal is chrome, zinc, zirconium etc.), fatty acid soap, long chain alkyl carboxylate, and resin acid soap.

One kind of a charge control agent may be used alone, or two or more kinds of charge control agents may be used in combination. A content of the charge control agent in a melted and kneaded product of toner materials is not particularly limited and may be appropriately selected from a wide range, but may be preferably in a range of 0.5 parts by weight to 4 parts by weight with respect to 100 parts by weight of binder resin. When the amount of the charge control agent to be added is less than 0.5 parts by weight, an effect of the charge control agent cannot be exerted. When the amount of the charge control agent to be added is more than 4 parts by weight, there arises a problem such as excessive charge.

(Production of Toner)

A preferable form of the melted and kneaded product of toner materials is, for example, a form containing 0.1 to 20% by weight of the coloring agent, 1 to 10% by weight of wax, 0.5 to 5% by weight of the charge control agent, and a remaining portion being binder resin. The toner materials are dry-mixed by a mixer, and the resulting mixture is melted and kneaded by a kneader.

During melting and kneading, the toner materials are heated up to a temperature (normally approximately 80 to 200° C., preferably approximately 100 to 150° C.) equal to or higher than a melting temperature of binder resin. A mixer used herein may be publicly known one, and may be, for example, Henschel type mixing devices such as a Henschel Mixer (product name, manufactured by Mitsui Mining Co., Ltd.), a Super Mixer (product name, manufactured by KAWATA MFG CO., Ltd.), and MECHANOMILL (product name, manufactured by OKADA SEIKO CO., LTD.), Angmill (product name, manufactured by HOSOKAWA MICRON CO., LTD.), a Hybridization System (product name, manufactured by NARA MACHINERY CO., LTD.), and a Cosmo System (product name, manufactured by Kawasaki Heavy Industries, Ltd.).

The kneader used herein may be publicly known one, and may be a general kneader such as a twin-screwed extruder, a triple roll mill, and a laboplastomill. More specifically, the kneader may be a single-screwed or twin-screwed extruder such as TEM-100B (product name, manufactured by TOSHIBA MACHINE CO., LTD.) or an open roll type kneader such as PCM-65/87 (product name, manufactured by Ikegai Corp.).

The melted and kneaded product obtained by melting and kneading the toner materials is cooled down and solidified so as to obtain a resin composition containing the binder resin and the coloring agent. The resin composition obtained by melting and kneading the toner materials is pulverized by a hammer mill or a cutter mill into coarse pulverized products whose particle diameter is in a range of approximately 100 μm to 5 mm. Thereafter, the coarse pulverized products are further pulverized into fine powder of 15 μm or less in particle diameter. Pulverization of the coarse pulverized products may be made using a jet pulverizer which pulverizes coarse pulverized products with a supersonic jet stream, or using an impact pulverizer which pulverizes coarse pulverized products by introducing the coarse pulverized products into a space between a rotor rotating at a high speed and a stator (liner). After pulverization by the pulverizer, classification is made so as to remove finer particles from toner particles.

An additive is externally added to the toner particles produced as above. Although the additive is not necessarily added, external addition of the additive yields effects of improving powder flowability, improving a frictional electrification property, improving heat resistance, improving long-storage stability, improving a cleaning property, and controlling of an abrasion property of a photoreceptor surface. Examples of the additive include silica fine powder, titanium oxide fine powder, and alumina fine powder. One type of the additive may be used alone or two or more types of the additive may be used in combination. A preferable amount of the additive to be added is 0.1 parts by weight or more but 3 parts by weight or less with respect to 100 parts by weight of toner particles, in consideration of an amount of charge necessary for toner, an influence on friction of a photoreceptor due to addition of the additive, environmental properties of the toner etc.

(Average Molecular Weight of Resin)

A number average molecular weight of resin and a weight average molecular weight of the resin are obtained based on a chart showing molecular weight distribution obtained by gel permeation chromatography through the above method.

(1) Preparation of Sample Solution

Resin is dissolved in tetrahydrofuran so that concentration of the resin is 0.5 g/100 mL. Then, the resulting solution is filtered by a fluorine resin filter whose pore size is 2 μm (manufactured by Sumitomo Electric Industries, Ltd., FP-200) so as to remove an insoluble component, thereby obtaining a sample solution.

(2) Measurement of Molecular Weight Distribution

Using a measurement device and an analysis column which are described below, tetrahydrofuran is flowed as a solution at a flow rate of 1 mL/min, and the column is stabilized in a constant temperature bath at 40° C. 100 μL of a sample solution is poured into the column and measurement is performed. A molecular weight of a sample is calculated based on an analytical curve prepared beforehand. The analytical curve used herein is prepared using several kinds of monodisperse polystyelene as a standard solution. Measurement device: HLC-8220GPC (manufactured by TOSOH CORPORATION)

Analysis column: Three TSK gel super HZM-H (manufactured by TOSOH CORPORATION) connected with one another (Softening Point of Resin)

Using an elevated flow tester (manufactured by Shimadzu Corporation, CFT-500D), 1 g of a sample is heated at a rising temperature of 6° C./min, and a load of 1.96 MPa is applied by a plunger to the sample so that the sample is extruded via a nozzle with a diameter of 1 mm and a length of 1 mm. Under these conditions, an S-shaped curve indicative of a relation between a plunger drop amount (flow value) of the flow tester and a temperature is drawn. At a temperature corresponding to h/2 wherein h indicates a height of the S-shaped curve, half of resin flows out and this temperature is regarded as a melting point (softening point).

(Melting Point of Wax)

Using differential scanning calorimetry (manufactured by Seiko Instruments & Electronics Ltd., DSC210), a sample is heated up to 200° C., and then cooed down to 0° C. in 5 minutes. The sample is measured at a rising temperature of 10° C./min. A melting point of wax is a peak temperature of a maximum endothermic peak (melting peak) observed with the DSC.

(THF Insoluble Component)

A resin sample is finely pulverized, 5.0 g of sample particles having passed through a sieve of 42 meshes (mesh size: 355 μm) are gathered, and are put in a 150 ml vessel together with 5.0 g of a filter aid Radiolite (#700), and 100 g of a THF solution is poured into the vessel, and the vessel is placed on a ball mill stand and is rotated for 5 hours or more so that the sample is dissolved sufficiently.

On the other hand, a filter paper (No. 2) with a diameter of 7 cm is placed inside a pressure filtration device, and the filter paper is evenly pre-coated with Radiolite thereon, and a little amount of the THF solution is added so that the filter paper is adhered to the filtration device, and then a content in the vessel is poured into the filtration device. The inside of the vessel is sufficiently washed with 100 ml of the solution and the solution is poured into the filtration device so that no residue remains adhering to a wall of the vessel. Thereafter, the filtration device is covered with a top lid, and filtration is carried out. Filtration is carried out under a pressure of 4 $kg/cm^3$ or less. After the solution stops to flow out from the filtration device, the filtration device is washed with 100 ml of the solution, and then pressure filtration is carried out again.

After the above operation is completed, all of the filtration paper, the residue on the filtration paper, and Radiolite are put on an aluminum foil and are placed in a vacuum drier, and dried at 85° C. under a pressure of 100 mmHg for 10 hours. A resulting dried object is weighed, and a weight ratio of the THF insoluble component is calculated.

(Acid Value of Resin)

Acid value was measured according to the method of JIS K0070 except for a solvent for measurement, which was changed from a mixture solvent of ethanol and ether according to JIS K0070 to a mixture solvent of acetone and toluene (acetone: toluene=1:1 (capacity ratio)).

(Epoxy Value)

Epoxy value was calculated according to a procedure below. An amount of 0.2 g to 5 g of a resin sample was precisely weighed and put in a 200 ml conical flask. Thereafter, 25 ml of dioxane was added so that the resin sample was dissolved. 25 ml of 1/5 normal hydrochloric acid solution (dioxane solvent) was added, and the conical flask was sealed hermetically and the resultant was mixed sufficiently. Thereafter, the resultant was left still for 30 minutes.

Thereafter, 50 ml of toluene-ethanol mixture solution (1:1 capacity ratio) was added and then titration of the resultant was carried out with cresol red as an indicator and a 1/10 normal sodium hydroxide aqueous solution as a titrant. An epoxy value (Eq/100 g) of the resultant was calculated based on the result of the titration in accordance with an equation below.

$$\text{Epoxy value (Eq/100 g)}=[(B-S)]\times N\times F]/(10\times W)$$

wherein W represents an amount (g) of the gathered sample, B represents an amount (ml) of the sodium hydroxide aqueous solution used in a test of the sample, S represents an amount (ml) of a sodium hydroxide aqueous solution used in the sample test, N represents normality of the sodium hydroxide aqueous solution, and F represents titer of the sodium hydroxide aqueous solution.

(Particle Size Distribution of Toner)

A toner in accordance with the embodiment of the present invention is a toner produced by subjecting a toner composition containing at least binder resin, a coloring agent, and wax to melting and kneading and thereafter pulverization and classification. The toner has a particle size distribution in which a volume median particle diameter (D50) of the toner is in a range of 5.5 μm to 7.5 μm, content ratios of toner base particles of not more than 3 μm, 4 μm, and 5 μm in particle diameter are in a range of 1.5% by number to 10% by number, 5% by number to 30% by number, and 15% by number to 55% by number, respectively, and a content ratio of toner base particles of more than 10 μm in particle diameter is 1.5% by number or less. With the particle size distribution, it is possible to obtain a toner with improved storage stability and durability and with high flowability. This improves developing property, thereby realizing a high-definition image with high quality. The particle size distribution of the toner can be realized by changing setting conditions of devices for pulverization and classification.

Particle size distribution of toner was measured using Coulter Multisizer II (manufactured by Beckman Coulter K.K.). The measurement was carried out as follows. Under conditions that an aperture size was 100 μm, a range of measured particle diameter was 2 μm to 60 μm, analysis software was Coulter Multisizer AccuComp version 1.19 (manufactured by Beckman Coulter K.K.), electrolyte was ISOTON II (manufactured by Beckman Coulter K.K.), dispersion liquid was EMULGEN 109P (manufactured by Kao Corporation, polyoxyethylene lauryl ether HLB 13.6), and percentage of the electrolyte was 5%, 10 mg of a sample to be measured was added to 5 ml of the dispersion liquid and the resultant was dispersed for 1 min by an ultrasonic disperser, and then 25 ml of the electrolyte was added, and then the resultant was dispersed for 1 min by the ultrasonic disperser, and 100 ml of the electrolyte and the dispersion liquid were added to a beaker, and 30,000 particles were measured at concentration that allows measurement of particle diameter of 30,000 particles to be carried out in 20 seconds, and particle size distribution of the 30,000 particles was obtained.

(Measurement of Viscoelasticity)

In the embodiment of the present invention, viscoelasticity, storage modulus G'(200) measured at 200° C. and at a frequency of 1 Hz, was obtained under conditions below.

Viscoelastic meter: STRESS TECH Rheometer (manufactured by REOLOGICA Instruments AB)
Measurement mode: Oscillation strain control
Measurement temperature: 200° C.
Frequency: 1 Hz (6.28 radian/sec)
Gap: 1 mm
Plate: parallel plate
Stress distortion: 1%
Shape of sample: cylindrical shape with a thickness of 1 mm and a diameter of approximately 20 mm

EXAMPLES

The following description will specifically discuss the embodiment of the present invention with reference to Examples.

[Production Example of Crosslinked Styrene Resin]

(Low Molecular Weight Polymerization Liquid L)

A solution containing 60 parts by weight of styrene, 12 parts by weight of n-butyl acrylate, 1.5 parts by weight of methacrylic acid, and 30 parts by weight of xylene solvent was prepared. Di-t-butyl peroxide was evenly dissolved in the solution in such a manner that di-t-butyl peroxide was 1.5 parts by weight with respect to 100 parts by weight of styrene. The resultant was continuously supplied at a rate of 750 cc/hr to a 5 liter reactor vessel with an internal temperature of 190° C. and an internal pressure of 6 kg/cm$^2$ so as to be polymerized, and thus a low molecular weight polymerization liquid L was obtained.

(High Molecular Weight Polymerization Liquid H)

73 parts by weight of styrene, 25 parts by weight of n-butyl methacrylate, and 1.5 parts by weight of methacrylic acid were put in a flask whose air was replaced with nitrogen, a temperature inside the flask was increased up to 120° C., and then bulk polymerization was carried out for 10 hours while the temperature inside the flask was kept at 120° C. Then, 50 parts by weight of xylene was added, and 0.1 pars by weight of dibutyl peroxide and 50 parts by weight of xylene which had been mixed and melted beforehand were continuously added for 8 hours while their temperatures were kept at 130° C., and then remaining monomers were polymerized for 2 hours so that polymerization was completed, and thus a high molecular weight polymerization liquid H was obtained.

(Production Example of COOH Group-Containing Vinyl Resin A)

50 parts by weight of the low molecular weight polymerization liquid L and 50 parts by weight of the high molecular weight polymerization liquid H were mixed with each other and then the mixture was flushed into a vessel at 160° C. and at 10 mmHg so as to remove the solvent etc. Resulting COOH group-containing vinyl resin A had a weight average molecular weight of 221,000 and an acid value of 18.0 KOHmg/g.

(Production Example of Glycidyl Group-Containing Vinyl Resin B)

60 parts by weight of xylene was put in a flask whose air was replaced with nitrogen and a temperature of the flask was increased. With reflow of xylene, 70 parts by weight of styrene, 25 parts by weight of n-butyl acrylate, 4 parts by weight of glycidyl methacrylate, and 1 part by weight of di-t-butyl peroxide were continuously added for 5 hours, and then reflow was continued for 1 hour. Thereafter, a temperature inside the flask was kept at 130° C., and residual monomers were polymerized for 2 hours, so that polymerization was completed and a polymerization liquid was obtained. The polymerization liquid was flushed into a vessel at 160° C. and at 1.33 kPa so as to remove the solvent etc. Resulting glycidyl group-containing vinyl resin had a weight average molecular weight of 31,000 and an epoxy value of 0.026 eq/100 g.

(Production Example of Crosslinked Styrene Resin C1)

88 parts by weight of COOH group-containing vinyl resin A and 12 parts by weight of glycidyl group-containing vinyl resin B were mixed with each other by a Henschel mixer, and then the mixture was reacted under kneading and mixing at 200° C. by a twin-screwed kneader (PCM-30 type, manufactured by Ikegai Corp.), and then cooled and pulverized. As a result, crosslinked styrene resin C1 containing a THF insoluble component was produced. Crosslinked styrene resin C1 thus obtained had a weight average molecular weight of 125,000, an acid value of 9 KOHmg/g, 29% by weight of the THF insoluble component, and a softening point of 140° C. Table 1 shows a production example of the crosslinked styrene resin C1 and properties thereof.

TABLE 1

| No. | COOH group-containing vinyl resin A Type | Parts by weight | Glycidyl group-containing vinyl resin B Type | Parts by weight | Polypropylene wax Parts by weight | Kneading temperature ° C. | Weight average molecular weight | Acid value KOHmg/g | THF insoluble component % by weight | Softening point ° C. | Viscoelasticity G'(200) |
|---|---|---|---|---|---|---|---|---|---|---|---|
| C1 | A | 88 | B | 12 | — | 200 | 125000 | 9 | 29 | 140 | 3100 |
| C2 | A | 88 | B | 12 | 2.5 | 200 | 119000 | 9 | 27 | 138 | 2900 |
| C3 | A | 92 | B | 8 | — | 180 | 82000 | 15 | 11 | 128 | 1600 |
| C4 | A | 84 | B | 16 | — | 220 | 168000 | 4 | 49 | 152 | 4200 |

(Production Example of Crosslinked Styrene Resin C2)

88 parts by weight of COOH group-containing vinyl resin A, 12 parts by weight of glycidyl group-containing vinyl resin B, and 2.5 parts by weight of polypropylene wax (NP055/manufactured by Mitsui Chemicals, Inc., melting point 144° C.) were mixed with each other by a Henschel mixer, and then the mixture was reacted under kneading and mixing at 200° C. by a twin-screwed kneader (PCM-30 type, manufactured by Ikegai Corp.), and then cooled and pulverized. As a result, crosslinked styrene resin C2 containing a THF insoluble component was produced. Crosslinked styrene resin C2 thus obtained had a weight average molecular weight of 119,000, an acid value of 9 KOHmg/g, 27% by weight of the THF insoluble component, and a softening point of 138° C. Table 1 shows a production example of the crosslinked styrene resin C2 and properties thereof.

(Production Example of Crosslinked Styrene Resin C3)

92 parts by weight of COOH group-containing vinyl resin A and 8 parts by weight of glycidyl group-containing vinyl resin B were mixed with each other by a Henschel mixer, and then the mixture was subjected to a kneading reaction at 180° C. by a twin-screwed kneader (PCM-30 type, manufactured by Ikegai Corp.) and cooled and pulverized. Thus, crosslinked styrene resin C3 containing a THF insoluble component was produced. Crosslinked styrene resin C3 thus obtained had a weight average molecular weight of 82,000, an acid value of 15 KOHmg/g, 11% by weight of the THF insoluble component, and a softening point of 128° C. Table 1 shows a production example of the crosslinked styrene resin C3 and properties thereof.

(Production Example of Crosslinked Styrene Resin C4)

84 parts by weight of COOH group-containing vinyl resin A and 16 parts by weight of glycidyl group-containing vinyl resin B were mixed with each other by a Henschel mixer, and then the mixture was reacted under kneading and mixing at 220° C. by a twin-screwed kneader (PCM-30 type, manufactured by Ikegai Corp.), and then cooled and pulverized. As a result, crosslinked styrene resin C4 containing a THF insoluble component was produced. Crosslinked styrene resin C4 thus obtained had a weight average molecular weight of 168,000, an acid value of 4 KOHmg/g, 49% by weight of the THF insoluble component, and a softening point of 152° C. Table 1 shows a production example of the crosslinked styrene resin C4 and properties thereof.

[Production Example of Non-Crystalline Polyester Resin]

(Production Example of High Molecular Weight Polyester Resin D)

Raw material monomers of 75 parts by weight of BPA-PO/polyoxypropylene (2,2)-2,2-bis(4-hydroxyphenyl) propane, 25 parts by weight of BPA-EO/polyoxyethylene (2,2)-2,2-bis(4-hydroxyphenyl) propane, and 85 parts by weight of terephthalic acid, and 10 g of esterified catalyst were put in a 5 liter four neck flask equipped with a nitrogen inlet tube, a dewatering conduit, a stirrer, and a thermocouple, and these components were reacted at 220° C. for 5 hours and then reacted at 8.3 kPa for 1 hour. Thereafter, 15 parts by weight of trimellitic acid anhydride was added at 210° C., and the resultant was reacted until the resultant reached a desired softening point, so that high molecular weight polyester resin D was produced. The high molecular weight polyester resin D thus obtained had a weight average molecular weight of 113,000, 3% by weight of a THF insoluble component, and a softening point of 131° C.

(Production Example of Low Molecular Weight Polyester Resin E)

In a 5 liter four neck flask equipped with a nitrogen inlet tube, a dewatering conduit, a stirrer, and a thermocouple, raw material monomers of 75 parts by weight of BPA-PO/polyoxypropylene (2,2)-2,2-bis(4-hydroxyphenyl) propane, 25 parts by weight of BPA-EO/polyoxyethylene (2,2)-2,2-bis(4-hydroxyphenyl) propane, and 85 parts by weight of terephthalic acid, and 8 g of esterified catalyst were put, and these components were reacted at 230° C. for 3 hours and then cooled down to 180° C., and 15 parts by weight of fumaric acid was added thereto. The resultant was reacted for 2 hours while increasing a temperature of the resultant at a rate of 15° C./hour from 180° C. to 210° C., and then the resultant was subjected to a decompressed reaction at 210° C. and 8.3 kPa until the resultant reached a predetermined softening point, so that low molecular weight polyester resin E was produced. The low molecular weight polyester resin E thus obtained had a weight average molecular weight of 16,000, no THF insoluble component, and a softening point of 106° C.

(Wax)

In Examples, paraffin wax (HNP-9, melting point 75° C., manufactured by NIPPON SEIRO CO., LTD.) or ester wax (Nissan Elector WEP-8, melting point 80° C., manufactured by NOF CORPORATION) was used.

(Coloring Agent and Charge Control Agent)

In Examples, carbon black (MA100, manufactured by Mitsubishi Kasei Corporation) was used as a coloring agent, and a boron compound of benzilic acid derivative (LR-147, manufactured by Japan Carlit Co., Ltd.) was used as a charge control agent.

Example 1

The toner composition shown in Table 2 was sufficiently mixed by a Henschel mixer, and then the resulting mixture was melted and kneaded by an open-roll kneader "Kneadex" (manufactured by Mitsui Mining Co., Ltd., external diameter of roll: 140 cm, effective length of roll: 80 cm). In the continuous double roll kneader, a high-rotating roll had a heating medium whose temperature was 125° C. at a side into which materials were put, and a cooling medium whose temperature was 100° C. at a side from which a kneaded product was extruded, and a low-rotating roll had a heating medium whose temperature was 75° C. at a side into which materials were put, and a cooling medium whose temperature was 35° C. at a side from which a kneaded product was extruded. The resulting kneaded product was cooled down and roughly pulverized and then pulverized by a fluidized bed pulverizer (CGS16: manufactured by ALPINE A.G.) under conditions that revolutions of rotor per minute was 8,000 rpm and air pressure was 1.0 MPa, and classified by a rotor classifier (TTSP: manufactured by ALPINE A.G.). Large size particles which had not been sufficiently pulverized were supplied to the pulverizer again. Conditions for pulverization and classification were adjusted such that a volume average particle diameter (D50) of toner obtained as a result of classification was 6.5 μm, particles of 5 μm or less in particle diameter were less than 45%, and coefficient of variation of the number of particles was 30% or less. With respect to the toner particles thus obtained, classification yield per 1 hour, volume average particle diameter (D50), a content ratio of particles of 5 μm or less in particle diameter, coefficient of variation of the number of particles, and THF insoluble content are shown in Table 2.

TABLE 2

| No. | High molecular weight polyester resin D Parts by weight | Low molecular weight polymer resin E Parts by weight | Crosslinked styrene resin C type | Crosslinked styrene resin C Parts by weight | Paraffin wax Parts by weight | Ester wax Parts by weight | Coloring agent Parts by weight | Charge control agent Parts by weight |
|---|---|---|---|---|---|---|---|---|
| Ex. 1 | 48 | 47 | C1 | 5 | 3.5 | — | 8 | 1 |
| Ex. 2 | 45 | 45 | C1 | 10 | 3.5 | — | 8 | 1 |
| Ex. 3 | 45 | 45 | C2 | 10 | — | 3.5 | 8 | 1 |
| Ex. 4 | 43 | 42 | C1 | 15 | 3.5 | — | 8 | 1 |
| Ex. 5 | 45 | 45 | C1 | 10 | 3.5 | — | 8 | 1 |
| Ex. 6 | 45 | 45 | C2 | 10 | — | 3.5 | 8 | 1 |
| Co. Ex. 1 | 50 | 50 | — | 0 | 3.5 | — | 8 | 1 |
| Co. Ex. 2 | 38 | 37 | C1 | 25 | 3.5 | — | 8 | 1 |
| Co. Ex. 3 | 45 | 45 | C3 | 10 | 3.5 | — | 8 | 1 |
| Co. Ex. 4 | 45 | 45 | C4 | 10 | 3.5 | — | 8 | 1 |
| Co. Ex. 5 | 45 | 45 | C1 | 10 | 3.5 | — | 8 | 1 |
| Co. Ex. 6 | 45 | 45 | C2 | 10 | — | 3.5 | 8 | 1 |

| No. | Classification yield per 1 hour % by weight | Volume median particle diameter (D50) μm | Content ratio of particles with size of not more than 5 μm % | Content ratio of particles with size of more than 10 μm % | coefficient of variation of the number of particles % | THF insoluble component % by weight |
|---|---|---|---|---|---|---|
| Ex. 1 | 80 | 6.5 | 45 | 0.6 | 26.2 | 1-2 |
| Ex. 2 | 82 | 6.5 | 43 | 0.7 | 25.5 | 2-3 |
| Ex. 3 | 82 | 6.5 | 42 | 0.4 | 25.9 | 2-3 |
| Ex. 4 | 83 | 6.5 | 40 | 0.5 | 24.7 | 4 |
| Ex. 5 | 79 | 5.5 | 53 | 0.2 | 30.1 | 2-3 |
| Ex. 6 | 84 | 7.5 | 20 | 1.3 | 24.3 | 2-3 |
| Co. Ex. 1 | 53 | 6.5 | 62 | 0.5 | 45.8 | 0-1 |
| Co. Ex. 2 | 86 | 6.5 | 42 | 0.3 | 24.3 | 7 |
| Co. Ex. 3 | 65 | 6.5 | 58 | 0.4 | 40.6 | 2-3 |
| Co. Ex. 4 | 84 | 6.5 | 42 | 0.6 | 24.7 | 2-3 |
| Co. Ex. 5 | 83 | 5.2 | 64 | 0.2 | 34.3 | 2-3 |
| Co. Ex. 6 | 85 | 8.0 | 11 | 4.5 | 24.5 | 2-3 |

Then, 2 parts by weight of hydrophobic silica "R976S" (manufactured by AEROSIL Japan, average primary particle diameter 7 nm) was mixed with and externally added to 100 parts by weight of the resulting toner particles by a Henschel mixer, so as to produce toner in Example 1.

Examples 2-6 and Comparative Examples 1-6

Toner particles in Examples 2-6 and Comparative Examples 1-6 were produced from the toner composition shown in Table 2 in a manner similar to Example 1. Conditions for pulverization and classification in Example 5 were adjusted such that volume average particle diameter (D50) of toner obtained as a result of classification was 5.5 μm, particles of 5 μm or less in particle diameter were less than 55%, and coefficient of variation of the number of particles was 35% or less.

Conditions for pulverization and classification in Example 6 were adjusted such that volume average particle diameter (D50) of toner obtained as a result of classification was 7.5 μm, particles of 5 μm or less in particle diameter were less than 30%, and coefficient of variation of the number of particles was 30% or less.

Conditions for pulverization and classification in Comparative Example 5 were adjusted such that volume average particle diameter (D50) of toner obtained as a result of classification was 5.2 μm, particles of 5 μm or less in particle diameter were less than 60%, and coefficient of variation of the number of particles was 40% or less.

Conditions for pulverization and classification in Comparative Example 6 were adjusted such that volume average particle diameter (D50) of toner obtained as a result of classification was 8.0 μm, particles of 5 μm or less in particle diameter were less than 25%, and coefficient of variation of the number of particles was 30% or less. With respect to the toner particles thus obtained, classification yield, volume average particle diameter (D50), a content ratio of particles of 5 μm or less in particle diameter, coefficient of variation of the number of particles, and THF insoluble component are shown in Table 2.

2 parts by weight of hydrophobic silica "R976S" (manufactured by Nippon AEROSIL, average primary particle diameter 7 nm) was mixed with and externally added to 100 parts by weight of the resulting toner particles by a Henschel mixer, so as to produce toner in Examples 2-5 and Comparative Examples 1-4.

(Production of Carrier)

Ferrite raw materials (manufactured by KDK) were mixed by a ball mill and then prebaked in a rotary kiln at 900° C. The resulting prebaked powder was finely pulverized by a wet pulverizer (steal ball was used as a pulverizing medium) into particles of 2 μm or less in average particle diameter. The resulting ferrite powder was granulated by a spray dry method, and granulated products were baked at 1,300° C. After baking, the granulated products were crushed by a crusher, so that core particles made of a ferrite component with a volume average particle diameter of approximately 40 μm and a volume resistivity of $3\times10^9$ Ω·cm were obtained.

Next, 100 parts by weight of dimethyl silicone resin (manufactured by Toshiba Silicone Co., Ltd.) and 5 parts by weight of octylic acid serving as a curing agent were dissolved in toluene, so that a coating application liquid for forming a thermosetting silicone resin layer which coats the core particles was obtained. Using a dip coating device which dips core particles in the coating application liquid, the core particles were coated with the resin layer. Thereafter, toluene was evaporated and removed completely from the coated core particles, and the coated core particles were cured at 190° C. for 30 minutes, so that carrier was obtained. The carrier thus obtained had a volume average particle diameter of 43 μm, a coating ratio of 100%, a volume resistivity of $2\times10^{12}$ ∩·cm, and saturation magnetization of 65 emu/g.

(Production of Two-Component Developer)

Using a Nauta mixer (manufactured by HOSOKAWA MICRON CORPORATION, type: VL-0), 6 parts by weight of each of the toners obtained in Examples 1-10 and Comparative Examples 1-10, respectively, and 94 parts by weight of the carrier were stirred and mixed for 25 minutes, so that two-component developers were produced.

(Evaluation)

Individual toners obtained as above were evaluated in terms of storage stability, and individual two-component developers were evaluated in terms of flowability, electrostatic property, white fogging, optical density, image evaluation, fixing property, high-temperature offset resistance, and filming resistance property. A device used here was a digital multifunction printer having high-speed developing devices (manufactured by Sharp Corporation, type: MX-4500FN). The two-component developers were set to the digital multifunction printer and printing evaluation was performed. Aging was carried out in such a manner that a document with a printing ratio of 5% was printed on 100,000 sheets of A4PPC paper in an environment with a temperature of 20° C. and a humidity of 45%.

(Evaluation of Flowability)

The two-component developers were set to the digital multifunction printer and subjected to aging printing of 100,000 sheets, and then the two-component developers were evaluated in terms of flowability using a bulk density measurement device (JIS bulk density measurement device, manufactured by TSUTSUI SCIENTIFIC INSTRUMENTS CO., LTD.) according to JIS K5101-12-1 (general test method for measuring apparent density or apparent specific value of pigment and extender by loose packing method). Larger bulk density indicates better flowability. An evaluation standard is as follows.

○: Excellent (bulk density of not less than 0.39 g/cm$^3$)

Δ: Good (bulk density of not less than 0.35 g/cm$^3$ and less than 0.39 g/cm$^3$)

X: Poor (bulk density of less than 0.35 g/cm$^3$)

(Evaluation of Electrostatic Property)

The two-component developers were set to the digital multifunction printer, and only the developing devices were consecutively driven for 3 minutes while the digital multifunction printer was adjusted not to develop images on photoreceptors. Then, the developers were sampled, and charge amounts of the two-component developers were measured and evaluated using a small-sized draw-off charge measurement device (manufactured by TREK JAPAN, type: 210HS-2A) based on the standard below.

○: Excellent (charge amount of not less than 30 μC/g and less than 40 μC/g)

Δ: Good (charge amount of not less than 25 μC/g and less than 30 μC/g or not less than 40 μC/g and less than 45 μC/g)

X: Poor (charge amount of less than 25 μC/g or not less than 45 μC/g)

(Evaluation of White Fogging)

The two-component developers were set to the digital multifunction printer and subjected to aging printing of 100,000 sheets, and then samples for evaluation were printed and their white portions were evaluated visually. The evaluation standard is as follows.

○: Excellent (white fogging is hardly observed)

Δ: Good (white fogging is observed in such a little amount that is not substantially problematic)

X: Poor (white fogging is observed in a large amount)

(Evaluation of Optical Density)

Amounts of toner attached onto recording paper at a solid portion of the evaluation sample were adjusted so as to be 0.8 mg/cm$^2$, two-component developers were set to the digital multifunction printer and subjected to aging printing of 100,000 sheets, and then evaluation samples were printed and images of solid portions of the evaluation samples were evaluated in terms of optical density. Optical density was evaluated using a spectrophotometer (product name; X-Rite938: manufactured by Nihonheihankizai K.K.).

○: Excellent (optical density of not less than 1.85)

Δ: Good (optical density of not less than 1.7 and less than 1.85)

X: Poor (optical density of less than 1.7)

(Evaluation of Gloss)

In order that an amount of toner attached onto recording paper at a solid portion of the evaluation sample is 0.8 mg/cm$^2$, fixing conditions were adjusted such that a temperature of the fixing roller was 190° C. and a rotational speed of the fixing roller was 270 mm/sec, and the two-component developers were set to the digital multifunction printer and subjected to aging printing of 100,000 sheets and then evaluation samples were printed and images of solid portions of the evaluation samples were evaluated in terms of gloss. Gloss was evaluated using a gloss meter (product name; PG-1/60°, manufactured by NIPPON DENSHOKU INDUSTRIES Co., LTD).

○: Excellent (gloss of not less than 20 and less than 30)

Δ: Good (gloss of not less than 15 and less than 20 or not less than 30 and less than 40)

X: Poor (gloss of less than 15 or not less than 40)

(Evaluation of Image Quality)

The two-component developers were set to the digital multifunction printer and subjected to aging printing of 100,000 sheets, and then evaluation samples were printed and half tone images of the evaluation samples were evaluated visually in terms of image quality according to the evaluation standard below.

○: Excellent (although a part of the half tone image looks granular, the half tone image looks smooth as a whole)

Δ: Good (the half tone image looks uneven and a little granular here and there)

X: Poor (the half tone image looks remarkably uneven and granular or has spattered toners thereon)

(Evaluation of Low-Temperature Fixability)

The two-component developers were set to the digital multifunction printer and subjected to aging printing of 100,000 sheets, and then evaluation samples were printed while a surface temperature of a fixing heat roller was changed by 10° C. from 100° C. to 150° C. An ink eraser with a load of 1 kg was caused by a color fastness rubbing tester to shuttle and rub between a solid portion and a white background portion three times, and optical reflection density (image density) before rubbing and after rubbing was measured by a reflection densitometer (manufactured by Gretag Macbeth GmbH), and a fixation ratio (%) was calculated based on an equation below. A lowest temperature in a case where the fixation ratio was more than 70% was considered as a fixation temperature.

$$\text{Fixation ratio (\%)}=[(\text{image density after rubbing})/(\text{image density before rubbing})]\times 100$$

○: Excellent (fixation temperature is not higher than 140° C. and offset does not occur)

Δ: Good (fixation temperature is not higher than 150° C. and offset does not occur)

X: Poor (fixation temperature is higher than 150° C. or offset occurs)

(Evaluation of High-Temperature Offset Resistance)

The two-component developers were set to the digital multifunction printer and subjected to aging printing of 100,000 sheets, and then evaluation samples were printed while a surface temperature of the fixing heat roller was sequentially increased by 10° C. from 170° C. to 260° C. Images of the printed evaluation samples were observed visually, and it was confirmed whether toner was transferred again from the fixing heat roller to a white background portion which serves as a white background of a recording sheet. In a case where toner was transferred again to the white background portion, it was determined that a high-temperature offset phenomenon occurred, and in a case where toner was not transferred again to the white background portion, it was determined that the high-temperature phenomenon did not occur.

○: Excellent (high-temperature offset temperature is not less than 210° C.)

Δ: Good (high-temperature offset temperature is not less than 200° C.)

X: Poor (high-temperature offset temperature is less than 200° C.)

(Comprehensive Evaluation)

Individual toners were comprehensively evaluated based on the results of evaluations above in accordance with a standard below.

◎: Particularly excellent (no Δ and X exist in each result of evaluation)

○: Excellent (no X exists and not more than three Δ exist in each result of evaluation)

X: Poor (X exists or at least four Δ exist in at least one of the results of evaluations)

Table 3 shows (i) the results of evaluations on the toners in Examples and Comparative Examples in terms of storage stability, (ii) the results of evaluations on the two-component developers in Examples and Comparative Examples in terms of flowability, electrostatic property, white fogging, optical density, gloss, image evaluation, fixing property, high-temperature offset resistance, and filming resistance property, and (iii) the results of comprehensive evaluations on the toners. The toners in accordance with the embodiment of the present invention showed excellent results in terms of all the evaluations.

TABLE 3

| Result of evaluation | | | | | | | | |
|---|---|---|---|---|---|---|---|---|
| | Flowability | | Electrostatic property | | | Optical density | | Gloss |
| Test No. | Measured value ($g/cm^3$) | Evaluation | Measured value (μC/g) | Evaluation | White fogging | Measured value | Evaluation | Measured value |
| Ex. 1 | 0.40 | ○ | 34.6 | ○ | ○ | 1.88 | ○ | 25 |
| Ex. 2 | 0.41 | ○ | 36.2 | ○ | ○ | 1.89 | ○ | 24 |
| Ex. 3 | 0.42 | ○ | 35.7 | ○ | ○ | 1.90 | ○ | 27 |
| Ex. 4 | 0.41 | ○ | 36.6 | ○ | ○ | 1.91 | ○ | 22 |
| Ex. 5 | 0.38 | Δ | 32.3 | ○ | Δ | 1.89 | ○ | 24 |
| Ex. 6 | 0.41 | ○ | 36.3 | ○ | ○ | 1.82 | Δ | 25 |
| Co. Ex. 1 | 0.33 | X | 28.1 | Δ | Δ | 1.75 | Δ | 43 |
| Co. Ex. 2 | 0.42 | ○ | 38.8 | ○ | ○ | 1.88 | ○ | 14 |
| Co. Ex. 3 | 0.35 | Δ | 32.5 | ○ | Δ | 1.81 | Δ | 38 |
| Co. Ex. 4 | 0.42 | ○ | 37.9 | ○ | Δ | 1.89 | ○ | 17 |
| Co. Ex. 5 | 0.33 | X | 27.7 | Δ | Δ | 1.82 | Δ | 25 |
| Co. Ex. 6 | 0.40 | ○ | 35.4 | ○ | ○ | 1.84 | Δ | 23 |

| Test No. | Gloss Evaluation | Evaluation of image quality | Low-temperature fixability | | High-temperature offset resistance | | Comprehensive evaluation |
|---|---|---|---|---|---|---|---|
| | | | Measured value (° C.) | Evaluation | Measured valve (° C.) | Evaluation | |
| Ex. 1 | ○ | ○ | 130 | ○ | 210 | ○ | ◎ |
| Ex. 2 | ○ | ○ | 130 | ○ | 220 | ○ | ◎ |
| Ex. 3 | ○ | ○ | 130 | ○ | 220 | ○ | ◎ |
| Ex. 4 | ○ | ○ | 140 | Δ | 230 | ○ | ○ |

TABLE 3-continued

| | Result of evaluation | | | | | | |
|---|---|---|---|---|---|---|---|
| Ex. 5 | ○ | ○ | 130 | ○ | 220 | ○ | ○ |
| Ex. 6 | ○ | Δ | 130 | ○ | 220 | ○ | ○ |
| Co. Ex. 1 | X | Δ | 120 | ○ | 190 | X | X |
| Co. Ex. 2 | X | ○ | More than 150 | X | 260 | ○ | X |
| Co. Ex. 3 | Δ | Δ | 130 | ○ | 210 | Δ | X |
| Co. Ex. 4 | Δ | ○ | More than 150 | X | 240 | ○ | X |
| Co. Ex. 5 | ○ | Δ | 130 | ○ | 220 | ○ | X |
| Co. Ex. 6 | ○ | X | 130 | ○ | 220 | ○ | X |

(Examinations)

The following description will examine the toners in terms of flowability, gloss, low-temperature fixability, high-temperature offset resistance, grindability, and image quality with reference to Tables 1 to 3. As shown in Tables 2 and 3, in Examples 1 to 6, D(50) was not less than 5.5 μm and a content ratio of toner base particles of 5 μm or less in particle diameter was 55% by number or less, which were respectively in proper ranges for flowability. Accordingly, Examples 1 to 6 showed good or excellent flowability. In contrast, Comparative Examples 1 and 5 showed poor flowability.

In Comparative Example 1, D(50) was in a proper range for flowability. However, in Comparative Example 1, a content ratio of toner base particles of 5 μm or less in particle diameter was more than 55% by number, so that Comparative Example 1 showed poor flowability. It seems that another cause for poor flowability is that binder resin did not contain crosslinked styrene resin.

In Comparative Example 5, D(50) and a content ratio of toner base particles of 5 μm or less in particle diameter were respectively out of proper ranges for flowability, and thus particles were too small in size as a whole, so that Comparative Example 5 showed poor flowability.

In Examples 1 to 6, D(50) was not more than 7.5 μm, a content ratio of toner base particles of more than 10 μm in particle diameter was not more than 1.5% by number, and a content ratio of toner base particles of not more than 5 μm in particle diameter was not less than 15% by number, which were respectively in proper ranges for image quality, so that image quality was good or excellent. In contrast, in Comparative Example 6, D(50) was more than 7.7 μm, and a content ratio of toner base particles of more than 10 μm in particle diameter was more than 1.5% by number, thereby showing that particles were too large in size as a whole. Consequently, image quality was poor.

Furthermore, in Examples 1 to 6, polyester resin contained in binder resin was in an amount of not less than 75% by weight, crosslinked styrene resin was in an amount of not more than 20% by weight, and a THF insoluble component was in an amount of not more than 45% by weight, so that low-temperature fixability was good or excellent. In contrast, Comparative Examples 2 and 4 did not show low-temperature fixability.

In Comparative Example 2, crosslinked styrene resin contained in binder resin was in an amount of more than 20% by weight, so that low-temperature fixability was not obtained. In Comparative Example 4, a THF insoluble component was in an amount of more than 45% by weight, so that low-temperature fixability was not obtained.

Furthermore, in Examples 1 to 6, polyester resin contained in binder resin was in an amount of not less than 75% by weight, crosslinked styrene resin was in an amount of not less than 3% by weight, and a THF insoluble component in the crosslinked styrene resin was in an amount of not more than 15% by weight, so that high-temperature offset resistance was secured. In contrast, in Comparative Example 1, high-temperature offset resistance could not be secured. In Comparative Example 3, since a THF insoluble component in crosslinked styrene resin was in an amount of less than 15% by weight, high-temperature offset resistance was not excellent.

In Comparative Example 1, crosslinked styrene resin contained in binder resin was in an amount of less than 3% by weight, so that high-temperature offset resistance could not be secured.

In Comparative Example 3, a classification yield per 1 hour was as low as 65% by weight, thereby showing poor grindability. In Comparative Example 1, a classification yield per 1 hour was as low as 53% by weight, thereby showing poor grindability.

Furthermore, in Examples 1 to 6, polyester resin contained in binder resin was in an amount of not less than 75% by weight, crosslinked styrene resin was in an amount of 3 to 20% by weight, and storage modulus G'(200) of the crosslinked styrene resin was not less than 2,000, so that proper gloss could be secured. In contrast, in Comparative Example 3, storage modulus G'(200) of the crosslinked styrene resin was less than 2,000, so that excessive gloss could not be prevented. It is considered that in Comparative Example 1, proper gloss could not be secured since Comparative Example 1 did not contain crosslinked styrene resin, resulting in excessive gloss. It is considered that in Comparative Example 2, proper gloss could not be secured since Comparative Example 2 contained crosslinked styrene resin in a content of more than 20% by weight and so gloss did not increase.

In view of the above, when polyester resin is in an amount of 75 to 95% by weight, crosslinked styrene resin is in an amount of 3 to 20% by weight, and a THF insoluble component is in an amount of 15 to 45% by weight with respect to 100% by weight of binder resin, D(50) is 5.5 to 7.5 μm, a content ratio of toner base particles of not more than 5 μm in particle diameter is 15 to 55% by number, and a content ratio of toner base particles of more than 10 μm in particle diameter is not more than 1.5% by number, these numerals are in respective proper ranges for realizing excellent low-temperature fixability, excellent high-temperature offset resistance, excellent grindability, excellent flowability, and high quality image.

(Summary)

As described above, toner for electrostatic development in accordance with one embodiment of the present invention contains toner base particles produced by subjecting a toner composition containing binder resin, a coloring agent, and wax to melting and kneading and thereafter pulverization and classification, the binder resin containing polyester resin and crosslinked styrene resin, the polyester resin being in an amount of 75 to 95% by weight and the crosslinked styrene resin being in an amount of 3 to 20% by weight with respect to 100% by weight of the binder resin, the crosslinked styrene resin containing COOH group-containing vinyl resin and glycidyl group-containing vinyl resin, a THF insoluble component in the crosslinked styrene resin being in an amount of 15 to 45% by weight, and the toner having a volume median particle diameter (D50) of 5.5 to 7.5 μm, and the toner having particle size distribution in which the toner base particles include 15 to 55% by number of toner base particles of not more than 5 μm in particle diameter, and include not more than 1.5% by number of toner particles of more than 10 μm in particle diameter.

Accordingly, the present invention can provide toner capable of realizing stable fixing performance by securing both of low-temperature fixability and high-temperature offset resistance; realizing excellent grindability and flowability; and forming high-definition and high quality images.

In contrast, in a case where polyester resin contained in binder resin is in an amount of less than 75% by weight and crosslinked styrene resin contained in the binder resin is in an amount of less than 20% by weight, low-temperature fixability cannot be secured. On the other hand, in a case where the polyester resin contained in the binder resin is in an amount of more than 95% by weight and the crosslinked styrene resin contained in the binder resin is in an amount of less than 3% by weight, dispersibility of wax drops, so that not only flowability of toner cannot be secured but also grindability of the toner does not increase and high-temperature offset resistance cannot be obtained.

Furthermore, in a case where a THF insoluble component of a glycidyl group is in an amount of less than 15% by weight, grindability does not increase and a satisfactory high-temperature offset resistance cannot be secured. On the other hand, in a case where the THF insoluble component is in an amount of more than 45% by weight, low-temperature fixability cannot be obtained.

Furthermore, in a case where D(50) is less than 7.5 μm and a content ratio of toner base particles of not more than 5 μm in particle diameter is less than 15%, it is impossible to form high-definition high quality images. On the other hand, in a case where D(50) is less than 5.5 μm and a content ratio of toner base particles of not more than 5 μm in particle diameter is more than 55%, it is impossible to secure flowability. Furthermore, in a case where a content of toner base particles of more than 10 μm in particle diameter is more than 1.5% by number, it is impossible to form high-definition high quality images.

The toner in accordance with the embodiment of the present invention is arranged such that the polyester resin contains not less than 30 parts by weight of low-softening point polyester resin whose softening point is 100° C. to 120° C. with respect to 100 parts by weight of the binder resin, and G'(200) which is a storage modulus of the crosslinked styrene resin measured at 200° C. and at a frequency of 1 Hz is not less than 2,000.

With the arrangement, the low-softening point polyester resin secures low-temperature fixability, and the crosslinked styrene resin whose storage modulus G'(200) is not less than 2,000 subdues excess of gloss.

In contrast, in a case where the softening point is less than 100° C., it is possible to secure low-temperature fixability, but gloss becomes excessive. On the other hand, in a case where the softening point is more than 120° C., it is impossible to secure low-temperature fixability. Furthermore, in a case where storage modulus G'(200) of the crosslinked styrene resin is less than 2,000, it is impossible to subdue excess of gloss even when the softening point is in a range of 100° C. to 200° C.

The toner in accordance with the embodiment of the present invention is arranged such that the wax contains low-melting wax whose melting point is 70° C. to 100° C.

The melting point of the wax being 70° C. to 100° C. allows securing flowability and realizing both of low-temperature fixability and high-temperature offset resistance. In contrast, in a case where the melting point of the wax is less than 70° C., it is impossible to secure flowability. On the other hand, in a case where the melting point of the wax is more than 100° C., it is impossible to obtain low-temperature fixability.

The toner in accordance with the embodiment of the present invention is arranged such that the wax contains low-melting wax whose melting point is 70° C. to 100° C. and high-melting wax whose melting point is 120° C. to 160° C.

Containing the low-melting wax whose melting point is 70° C. to 100° C. and the high-melting wax whose melting point is 120° C. to 160° C. allows improving both of the low-temperature fixability and the high-temperature offset resistance. In contrast, in a case where the melting point of the high-melting wax is less than 120° C., it is impossible to improve the high-temperature offset resistance. On the other hand, in a case where the melting point of the high-melting wax is more than 160° C., it is impossible to improve the low-temperature fixability.

As described above, toner for electrostatic development in accordance with the embodiment of the present invention contains toner base particles produced by subjecting a toner composition containing binder resin, a coloring agent, and wax to melting and kneading and thereafter pulverization and classification, the binder resin containing polyester resin and crosslinked styrene resin, the polyester resin being in an amount of 75% by weight to 95% by weight and the crosslinked styrene resin being in an amount of 3% by weight to 20% by weight with respect to 100% by weight of the binder resin, the crosslinked styrene resin containing COOH group containing vinyl resin and glycidyl group containing vinyl resin, THF insoluble component in the crosslinked styrene resin being in an amount of 15 to 45% by weight, and the toner having particle size distribution in which a volume median particle diameter (D50) is 5.5 μm to 7.5 μm, and the toner base particles include 15% by number to 55% by number of toner base particles of not more than 5 μm in particle diameter, and include not more than 1.5% by number of toner particles of more than 10 μm in particle diameter.

With the arrangement, it is possible to provide toner capable of realizing stable fixing performance by securing both of low-temperature fixability and high-temperature offset resistance; realizing excellent grindability and flowability; and forming high-definition and high quality images.

The toner in accordance with one aspect of the present invention is arranged such that the polyester resin contains not less than 30 parts by weight of low-softening point polyester resin whose softening point is 100° C. to 120° C. with respect to 100 parts by weight of the binder resin, and G'(200) which is a storage modulus of the crosslinked styrene resin measured at 200° C. and at a frequency of 1 Hz is not less than 2,000.

With the arrangement, the low-softening point polyester resin secures low-temperature fixability, and the crosslinked styrene resin whose storage modulus G'(200) is not less than 2,000 subdues excess of gloss.

The toner in accordance with the embodiment of the present invention is arranged such that the wax contains low-melting wax whose melting point is 70° C. to 100° C.

With the arrangement, the melting point of the wax being 70° C. to 100° C. allows securing flowability and realizing both of low-temperature fixability and high-temperature offset resistance.

The toner in accordance with the embodiment of the present invention is arranged such that the wax contains low-melting wax whose melting point is 70° C. to 100° C. and high-melting wax whose melting point is 120° C. to 160° C.

With the arrangement, containing the low-melting wax whose melting point is 70° C. to 100° C. and the high-melting wax whose melting point is 120° C. to 160° C. allows improving both of the low-temperature fixability and the high-temperature offset resistance.

The present invention is not limited to the description of the embodiments above, but may be altered by a skilled person within the scope of the claims. An embodiment based on a proper combination of technical means disclosed in different embodiments is encompassed in the technical scope of the present invention.

The invention claimed is:

1. A toner for electrostatic development, containing toner base particles produced by subjecting a toner composition containing binder resin, a coloring agent, and wax to melting and kneading and thereafter pulverization and classification, the binder resin containing polyester resin and crosslinked styrene resin, the polyester resin being in an amount of 75% by weight to 95% by weight and the crosslinked styrene resin being in an amount of 3% by weight to 20% by weight with respect to 100% by weight of the binder resin, the crosslinked styrene resin containing COOH group-containing vinyl resin and glycidyl group-containing vinyl resin, a THF insoluble component in the crosslinked styrene resin being in an amount of 15% by weight to 45% by weight, and the toner having particle size distribution in which a volume median particle diameter (D50) is 5.5 to 7.5 μm, and the toner base particles include 15% by number to 55% by number of toner base particles of not more than 5 μm in particle diameter, and include not more than 1.5% by number of toner particles of more than 10 μm in particle diameter.

2. The toner as set forth in claim 1, wherein the polyester resin contains not less than 30 parts by weight of low-softening point polyester resin whose softening point is 100° C. to 120° C. with respect to 100 parts by weight of the binder resin, and G'(200) which is a storage modulus of the crosslinked styrene resin measured at 200° C. and at a frequency of 1 Hz is not less than 2,000.

3. The toner as set forth in claim 1, wherein the wax contains low-melting wax whose melting point is 70° C. to 100° C.

4. The toner as set forth in claim 1, wherein the wax contains low-melting wax whose melting point is 70° C. to 100° C. and high-melting wax whose melting point is 120° C. to 160° C.

5. An image forming device, using the toner for electrostatic development as set forth in claim 1.

6. An image forming method, using the image forming device as set forth in claim 5.

* * * * *